United States Patent [19]

Tepic

[11] Patent Number: 5,014,433

[45] Date of Patent: May 14, 1991

[54] SCISSORS FOR HOUSEHOLD AND MEDICAL USES

[75] Inventor: Slobodan Tepic, Davos, Switzerland

[73] Assignee: Laboratorium für experimentelle Chirurgie, Davos, Switzerland

[21] Appl. No.: 490,346

[22] Filed: Mar. 8, 1990

[51] Int. Cl.[5] ..... B26B 3/26; B26B 13/28; B26B 13/06; B26B 13/12

[52] U.S. Cl. ..... 30/248; 30/250; 30/251; 30/254

[58] Field of Search ..... 30/208, 249, 250, 251, 30/252, 253, 254, 257

[56] References Cited

U.S. PATENT DOCUMENTS

| | | | |
|---|---|---|---|
| 883,457 | 3/1908 | Geis | 30/250 |
| 942,043 | 11/1909 | Searight | 30/251 |
| 1,012,289 | 12/1911 | Stich | 30/250 |
| 2,084,633 | 6/1937 | Erickson | 30/250 |
| 2,442,424 | 6/1948 | McGary et al. | 30/251 |
| 2,528,816 | 11/1950 | Boyer | 30/238 |
| 2,744,323 | 5/1956 | Kuhlman | 30/251 |
| 3,486,227 | 12/1969 | Somervell | 30/250 |
| 3,572,192 | 3/1971 | Juras | 81/383.5 |
| 3,791,013 | 2/1974 | Rogers | 30/254 |
| 4,525,929 | 7/1985 | Brophy, Sr. et al. | 30/181 |

FOREIGN PATENT DOCUMENTS

| | | |
|---|---|---|
| 652637 | 11/1985 | Switzerland . |
| 1522144 | 10/1974 | United Kingdom . |

*Primary Examiner*—Douglas D. Watts
*Assistant Examiner*—Paul M. Heyrana, Sr.
*Attorney, Agent, or Firm*—Walter C. Farley

[57] ABSTRACT

The scissors for household and medical use comprise an upper and lower blade defining a distal region and an upper and lower handle defining a proximal region. The lower blade and handle are formed as one piece and the upper blade and handle are formed as two separate pieces. The upper blade is movably linked to the lower blade by means of a mechanism—e.g. a four-bar linkage—allowing to move said upper blade by acting on said upper handle leaving said one-piece lower blade and handle stationary.

2 Claims, 6 Drawing Sheets

SCISSORS FOR HOUSEHOLD AND MEDICAL USES

BACKGROUND OF THE INVENTION

This invention relates to a kinematic improvement in the function of common scissors. The common scissors have two cutting blades which extend proximally to form the two handles. These are movable past one another on a pivot placed centrally. The pivot holds the two blades/handles together. When the scissors are used over a large surface, e.g. when tailoring on a table, the required movement of the handles lifts the point of the cutting (where the blade edges slide past one another) up from the table, disturbing the position of the material being cut. This is particularly annoying with fine, soft fabrics. Making the handles bent upwards so as to lift them off the surface would allow the lower blade to remain flat on the table, but would result in poorly balanced and difficult to use scissors. The advantage of being able to somewhat push against the table would also be lost.

When such simple scissors are used for example to remove bandages, care must be exercised not to hurt the patent. This requires unnatural movement of the hand. As the lower blade of the scissors is controlled by the thumb of the operator, and it must not change angulation, the finger(s) of the hand and the whole hand must be moved to angulate the upper blade of the scissors. This movement can of course be learned, but does not come naturally.

The same is true of surgical scissors. Typically the lower blade is out of the sight of the surgeon and should not be angulated so as to point deeper into tissues. This requires the thumb to be stationary and the hand to move.

SUMMARY OF THE INVENTION

The invention as claimed is intended to provide a remedy for the above mentioned problems with common scissors with a rather simple kinematic arrangement of the scissor components. The lower blade of the scissors is controlled by the finger(s) of the hand, while the upper blade is articulated by the thumb. Two alternative mechanisms are proposed for the kinematic connection of the scissor components: one is based on the four-bar-linkage while the other uses a pair of (partial) gears.

The advantages offered by the invention are mainly the improved ergonomy of the scissors and better control over the cutting action, particularly when tailoring fabrics, or cutting tissues in surgery.

The various features of novelty which characterize the invention are pointed out with particularity in the claims annexed to and forming part of this disclosure. For the better understanding of the invention, its operating advantages and specific objects attained by its use, reference should be had to the accompanying drawings and descriptive matter in which are illustrated and described preferred embodiments of the invention.

DESCRIPTION OF THE PREFERRED EMBODIMENTS

Figure 1:
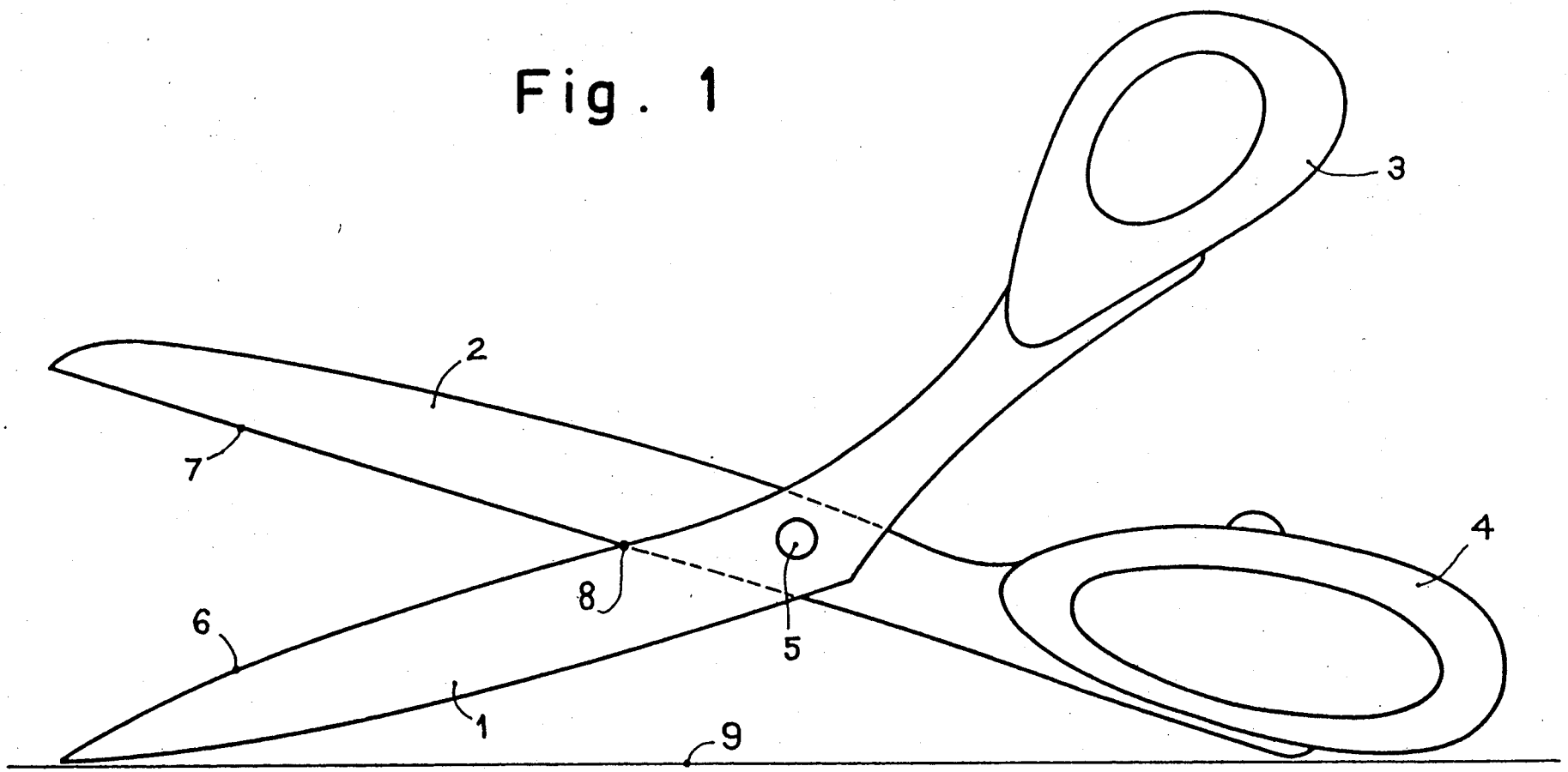
Fig. 1 PRIOR ART
FIG. 1 is a side view of a prior art scissors in the open state.
Figure 2:
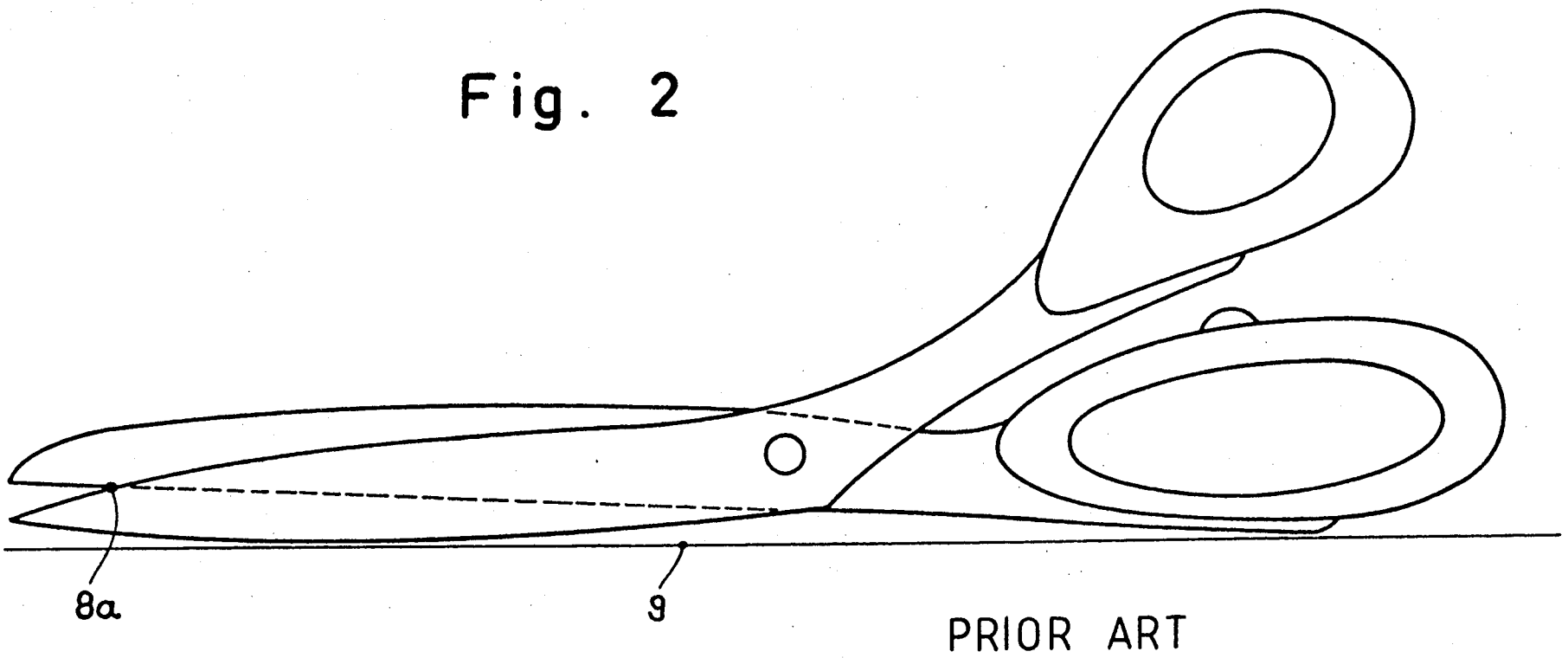
PRIOR ART Fig. 2
FIG. 2 is a side view of the prior art scissors according to FIG. 1 in the closed state.

FIG. 1 shows common scissors according to prior art. The lower blade 1 extends proximally towards the user—to form the upper handle 3. The upper blade 2 extends proximally to form the lower handle 4. The two blades/handles cross at the pivot 5 so as to be free to move past one another. The sharp edges 6 and 7 of the blades 1 and 2 cut the material as the handles 3 and 4 are pushed together. Comparing the height of the cutting point 8 above the table surface 9 on FIG. 1 where the scissors are opened, to the height of the point 8*a* on FIG. 2 where the scissors are closed, it becomes clear that the material being cut has to be repeatedly lifted off the table surface 9. Shaping the handles of tailoring scissors in special, ergonomic ways does not improve on this problem.

Figure 3:
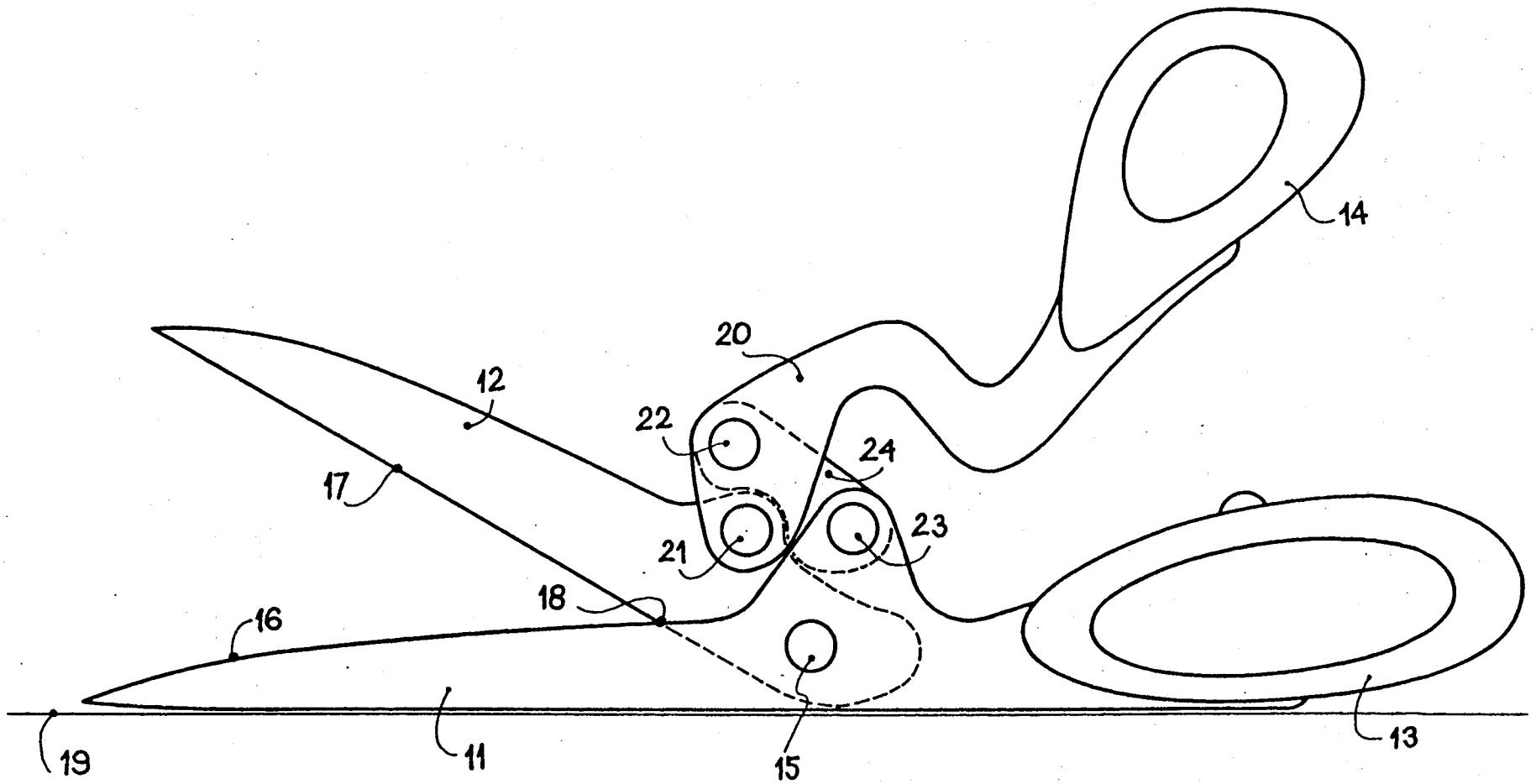
FIG. 3 is a side view of scissors according to the invention with a four-bar linkage in the open state.
Figure 4:
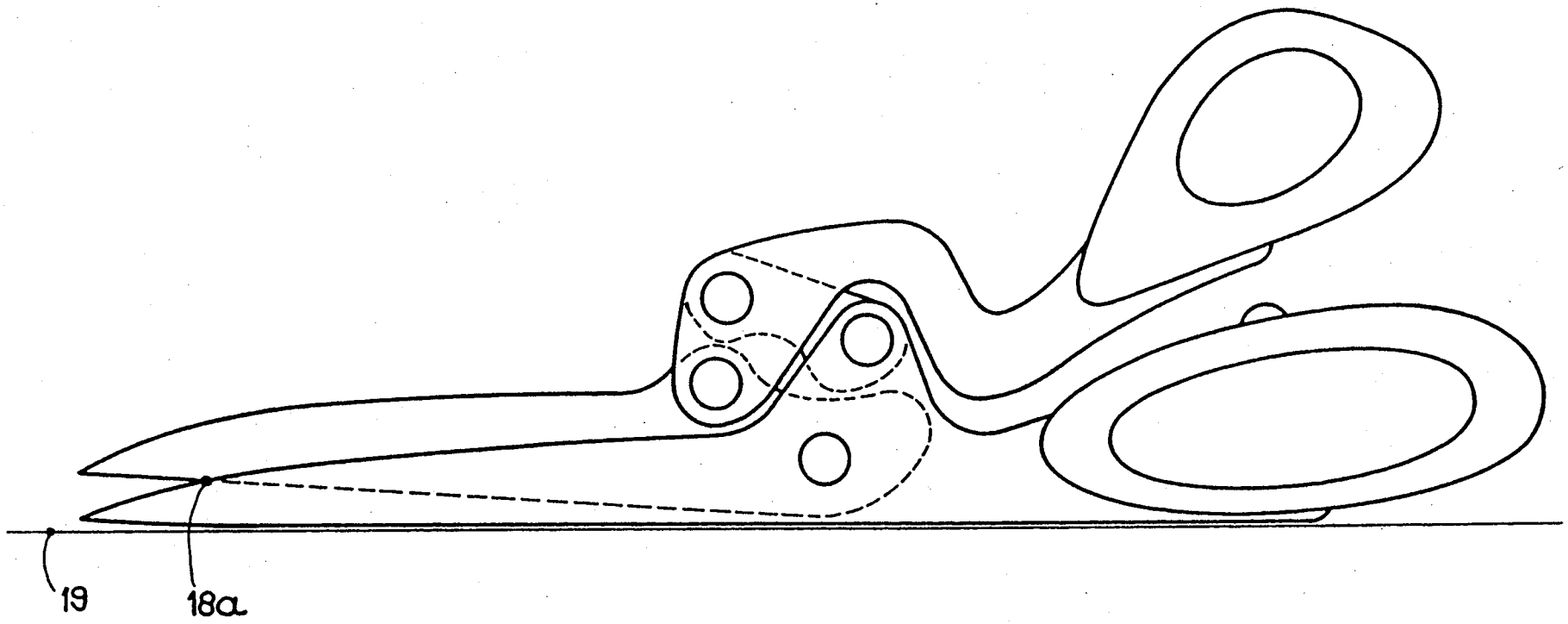
FIG. 4 is a side view of scissors according to FIG. 3 in the closed state.

FIG. 3 shows a preferred embodiment of the invention with a four-bar-linkage arranged so as to provide the desired kinematics for the scissors. The lower blade 11 of the scissors is one piece with the lower handle 13. The upper blade 12 is driven by the upper handle 14. The blades 11 and 12 are connected by the pivot 15. Distal part 20 of the upper handle 14 is connected to the upper blade 12 by the pivot 21. A short link 24 connects to the upper handle distal part 20 via pivot 22 and to the lower handle/blade 13;11 via pivot 23. Pivots 15,21,22 and 23 with the four parts of the scissors 11;13, 12, 24 and 20;14 form the four-bar linkage which drives the upper blade 12 while the lower blade 11 remains flat on the table surface 19. This allows the cutting point 18 to remain low over the table surface 19 when blades 11 and 12 are open as shown on the FIG. 3, as well as when they are closed as shown on the FIG. 4 (cutting point indicated as 18*a*).

Figure 5:
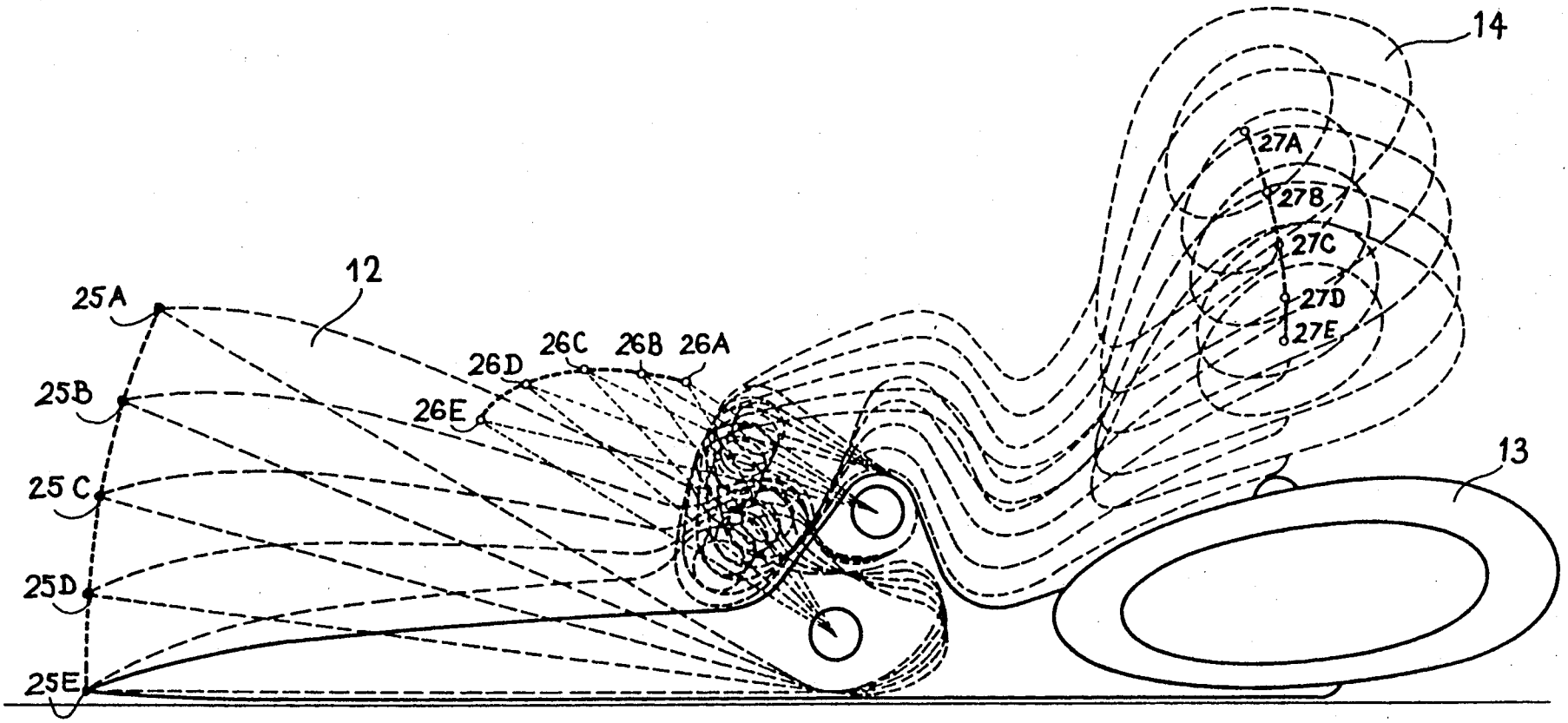
FIG. 5 is a side view of scissors according to FIG. 3 showing several positions between fully open and fully closed.

FIG. 5 shows five positions of the scissors from fully open to fully closed. As the center 27 of the upper handle 14 moves from the position 27A (over 27B,27C and 27D) to position 27E the tip 25 of the upper blade 12 moves from the position 25A (over 25B, 25C, and 25D) to 25E. The instantaneous center of rotation 26 between the upper handle 14 and the lower handle 13 is determined by the intersection of the lines connecting the pivots 21 to 15 and 22 to 23. It moves from the position 26A for the fully open scissors (over 26B, 26C and 26D) to the position 26E for the fully closed scissors.

Figure 6:
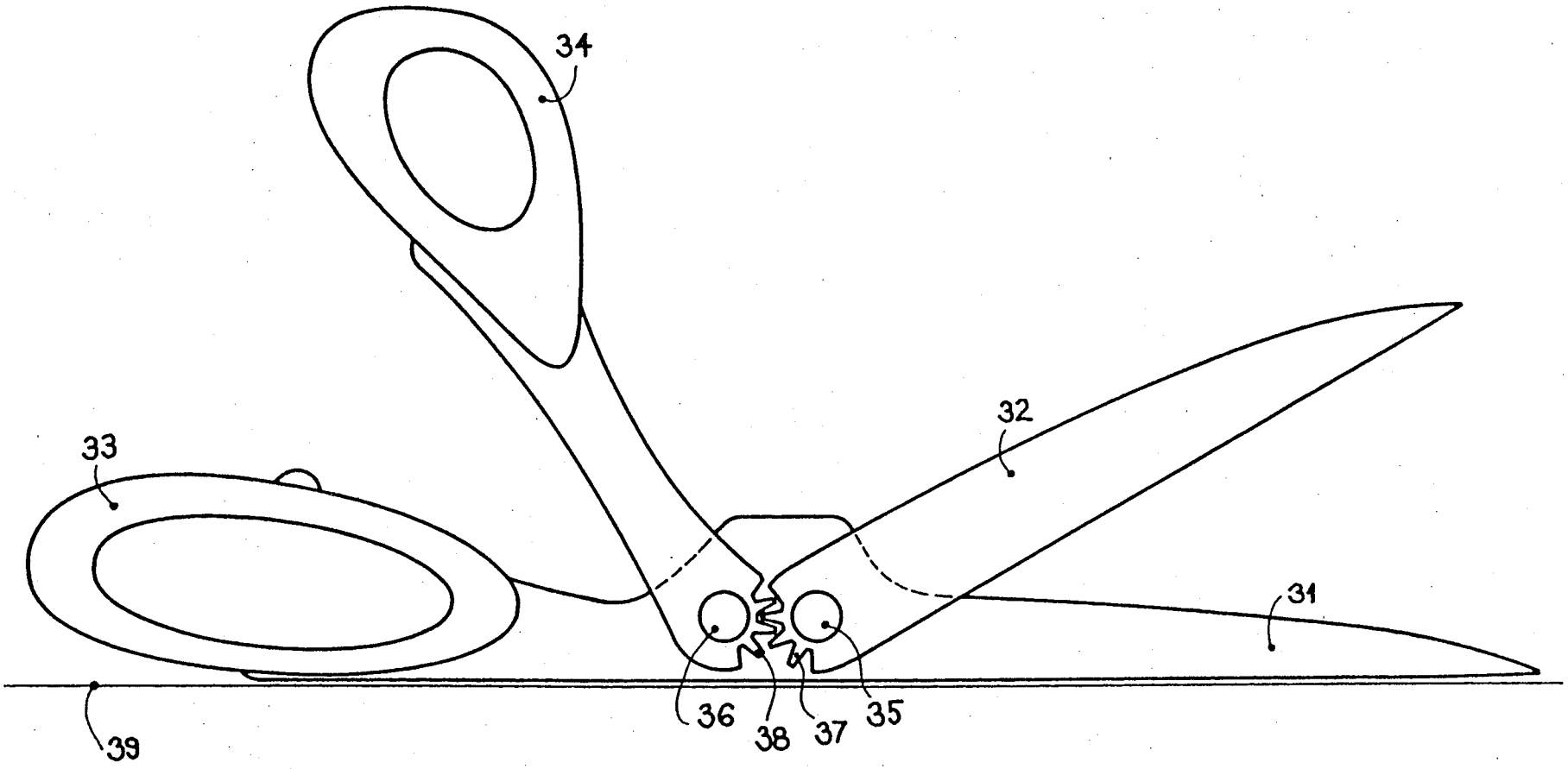
FIG. 6 is a side view of scissors according to the invention with a gear mechanism in the open state.

FIG. 6 shows a further preferred embodiment of the invention with a meshing gear mechanism. The upper blade 32 is provided at its proximal end with a geared section 37 which is rotatably connected distally to the center portion of the one-piece lower blade 31 and handle 33 by means of a first pivot 35. The upper handle 34 is provided at its distal end with a geared section 38 which is rotatably connected proximally to the center portion of the one-piece lower blade 31 and handle 33 by means of a second pivot 36. The two geared sections 37 and 38 are meshing and allow to move said upper blade 32 by acting on said upper handle 34 leaving said one-piece lower blade 31 and handle 33 stationary.

What is claimed is:

1. Scissors for household and medical use comprising upper and lower blades defining a distal region, upper and lower handles defining a proximal region, said lower blade and lower handle being one piece, and said upper blade and upper handle being two separate pieces;

means pivotally connecting said upper blade to said lower blade at a first pivot location;

means pivotally connecting said upper blade to said upper handle at a second pivot location; and a link bar pivotally connected to said upper handle and to said lower handle at third and fourth pivot locations, respectively, thereby forming a four-bar linkage movably linking said upper blade to said lower blade such that said upper blade is movable by said upper handle while leaving said one-piece lower blade and handle stationary.

2. Scissors according to claim 1 wherein the locus of instantaneous centers of rotation between said upper and lower handles as determined by intersections of lines passing respectively through the centers of said first and second pivot locations and said third and fourth pivot locations lies in said distal region for all positions of said upper blade.

* * * * *